US008721205B2

(12) United States Patent
Francis et al.

(10) Patent No.: US 8,721,205 B2
(45) Date of Patent: May 13, 2014

(54) CREDENTIAL MANUFACTURING DEVICE HAVING AN AUXILIARY CARD INPUT

(75) Inventors: Robert Francis, Savage, MN (US); Leon Gershenovich, Eden Prairie, MN (US); Mark Oeltjenbruns, Shakopee, MN (US)

(73) Assignee: HID Global Corporation, Irvine, CA (US)

( * ) Notice: Subject to any disclaimer, the term of this patent is extended or adjusted under 35 U.S.C. 154(b) by 1319 days.

(21) Appl. No.: 12/116,594

(22) Filed: May 7, 2008

(65) Prior Publication Data

US 2009/0097955 A1 Apr. 16, 2009

Related U.S. Application Data

(60) Provisional application No. 60/978,922, filed on Oct. 10, 2007.

(51) Int. Cl.
*B41J 3/60* (2006.01)
*B41J 13/12* (2006.01)

(52) U.S. Cl.
USPC ..... 400/521; 101/485

(58) Field of Classification Search
USPC ..... 400/521–544; 101/485
See application file for complete search history.

(56) References Cited

U.S. PATENT DOCUMENTS 5,326,179 A * 7/1994 Fukai et al. ..... 400/521
5,387,043 A * 2/1995 Fujioka et al. ..... 400/691
5,806,999 A 9/1998 Kobayashi ..... 400/188
5,814,796 A * 9/1998 Benson et al. ..... 235/375
6,236,420 B1 5/2001 Matsuzaka ..... 347/170
6,308,886 B1 * 10/2001 Benson et al. ..... 235/375
RE38,295 E * 11/2003 Kobayashi et al. ..... 235/449
7,018,117 B2 3/2006 Meier et al. ..... 400/208
7,154,519 B2 12/2006 Meier et al. ..... 347/211

(Continued)

FOREIGN PATENT DOCUMENTS

WO WO 02/01493 A2 1/2002
WO WO 03/076200 A1 9/2003
WO WO 2005/070687 8/2005

OTHER PUBLICATIONS

International Search Report and Written Opinion of PCT/US2008/010848 filed Sep. 18, 2008.

*Primary Examiner* — David Banh
(74) *Attorney, Agent, or Firm* — Brian D. Kaul; Westman, Champlin & Koehler, P.A.

(57) ABSTRACT

A credential manufacturing device includes a card supply positioned adjacent to a main card input and configured to hold a plurality of plastic card substrates, a card transport, a card processing device, an auxiliary input and a card rotator. The card transport is configured to feed individual card substrates from the card supply through the main card input and along a processing path. The card processing device is either a print head or a laminating roller and is in line with the processing path. The auxiliary input is displaced from the main card input and the processing path, and positioned in line with an auxiliary input path, which is transverse to the processing path. The auxiliary input is configured to receive individual card substrates for travel along the auxiliary input path. The card rotator is configured to rotate individual card substrates to a plurality of indexed angular orientations including a first orientation, in which the card rotator is oriented to the processing path and a second orientation in which the card rotator is oriented to the auxiliary input path.

19 Claims, 16 Drawing Sheets

(56) References Cited

U.S. PATENT DOCUMENTS

| | | | | |
|---|---|---|---|---|
| 7,344,325 | B2 | 3/2008 | Meier et al. | |
| 7,349,002 | B2 * | 3/2008 | Kanemaru et al. | 347/171 |
| 7,878,505 | B2 | 2/2011 | Meier et al. | |
| 2001/0052923 | A1 | 12/2001 | Suzuki | 347/217 |
| 2002/0036374 | A1 * | 3/2002 | Yui | 271/3.14 |
| 2002/0036376 | A1 * | 3/2002 | Yui | 271/83 |
| 2004/0081501 | A1 * | 4/2004 | Kobayashi et al. | 400/120.01 |
| 2004/0109715 | A1 | 6/2004 | Meier et al. | 400/191 |
| 2004/0164169 | A1 * | 8/2004 | Suzuki et al. | 235/488 |
| 2005/0082738 | A1 | 4/2005 | Bryant et al. | 271/10.01 |
| 2005/0140769 | A1 * | 6/2005 | Kanemaru et al. | 347/172 |
| 2006/0065718 | A1 | 3/2006 | Tsuruta | 235/381 |
| 2006/0071420 | A1 | 4/2006 | Meier et al. | 271/272 |
| 2006/0151935 | A1 | 7/2006 | Liatard et al. | |
| 2007/0099462 | A1 * | 5/2007 | Helma et al. | 439/159 |
| 2009/0083309 | A1 * | 3/2009 | Nehowig et al. | 707/102 |

* cited by examiner

CREDENTIAL MANUFACTURING DEVICE HAVING AN AUXILIARY CARD INPUT

CROSS-REFERENCE TO RELATED APPLICATION

The present application is based on and claims the benefit of U.S. provisional patent application Ser. No. 60/978,992, filed Oct. 10, 2007, the content of which is hereby incorporated by reference in its entirety.

BACKGROUND

The present invention generally relates to a credential manufacturing device and, more particularly, to a credential manufacturing device having an auxiliary input for receiving individual plastic card substrates for processing.

Credentials include identification cards, driver's licenses, passports, and other documents. Such credentials are formed from credential substrates including paper substrates, plastic substrates, cards and other materials. Credentials generally include printed information, such as a photo, account numbers, identification numbers, and other personal information. An overlaminate may also be laminated to the surfaces of the credential substrate to protect the surfaces from damage and, in some instances, provide a security feature (e.g., hologram). Additionally, credentials can include data that is encoded in a smartcard chip, a magnetic stripe, or a barcode, for example.

Credential manufacturing devices process credential substrates to complete at least a portion of the final credential. Exemplary processes performed by credential manufacturing devices include printing images on one or more surfaces of the credential substrate, laminating an overlaminate film to a surface of the credential substrate, writing or encoding data to the credential substrate, and other processes. Exemplary credential substrate processing components configured to perform these processes include a print head, a laminating roller, and an encoding device.

Card substrates used, for example, to form identification cards and credit cards, are typically rigid or semi-rigid card substrates that are formed of plastic. During the processing of such plastic card substrates it is desirable to avoid bending the cards. As a result, paper sheet feed mechanisms, found in traditional paper printers and copiers, are not suitable for handling the rigid or semi-rigid identification card substrates due to the damage that would result from the card substrate being fed through numerous bends around rollers that exist in the sheet feed path of traditional paper sheet feed mechanisms. Rather, credential manufacturing devices that are configured for handling the rigid or semi-rigid plastic card substrates include a card transport mechanism that is configured to feed the card substrate along a processing path that is substantially void of significant bends and is relatively flat.

In order to process both sides of a plastic card substrate, the card transport mechanism of a credential manufacturing device cannot invert the card substrate by routing the card around several rollers, as is the case for inverting a paper sheet in paper sheet printers and copiers. Rather, the necessity of having a relatively flat processing path to process plastic card substrates makes it necessary to utilize a card substrate "flipper" or "rotator" in order to invert the card substrate for dual-sided processing of the card substrate.

Card substrates are typically stored in a substrate supply, such as a hopper or a cartridge, and are fed from the supply along the substantially flat processing path for processing by the card processing components of the credential manufacturing device. Following the completion of the card substrate processing, the processed card substrate is discharged into a collection hopper or bin.

Occasionally, it may be desired to process a credential substrate, such as a card substrate, that is different from those contained in the supply. For instance, card substrates can have many different features including, for example, a magnetic bar code, a smart card chip and a proximity device. Additionally, cards may come in different sizes. Thus, in the event that one would like to process a card substrate that is different than those available in the supply, the operator must remove the card substrates from the supply and install the new substrate in the supply for processing. Following the processing of the new substrate, the previous substrates can be reinstalled in the supply to continue processing them. As a result, it can be somewhat cumbersome to process a different type of substrate than that found in the substrate supply.

Embodiments of the present invention provide solutions to these and other problems, and offer other advantages over the prior art.

SUMMARY

Embodiments of the invention are directed to credential manufacturing devices configured for processing plastic card substrates and methods of processing a plastic card substrate in a credential manufacturing device. In one embodiment, the credential manufacturing device includes a card supply positioned adjacent to a main card input and configured to hold a plurality of plastic card substrates, a card transport, a card processing device, an auxiliary input and a card rotator. The card transport is configured to feed individual card substrates from the card supply through the main card input and along a processing path. The card processing device is either a print head or a laminating roller and is in line with the processing path. The auxiliary input is displaced from the main card input and the processing path, and positioned in line with an auxiliary input path, which is transverse to the processing path. The auxiliary input is configured to receive individual card substrates for travel along the auxiliary input path. The card rotator is configured to rotate individual card substrates to a plurality of indexed angular orientations including a first orientation, in which the card rotator is oriented to the processing path and a second orientation in which the card rotator is oriented to the auxiliary input path.

One embodiment of the method utilizes a credential manufacturing device comprising a supply of plastic card substrates contained in a card supply positioned adjacent a main card input, a card transport configured to feed individual card substrates from the card supply through the main card input and along a processing path, a card processing device selected from the group consisting of a print head and a laminating roller, the card processing device is configured to process card substrates traveling along the processing path, an auxiliary input displaced from the main card input and the processing path and in line with an auxiliary input path, which is transverse to the processing path, a card rotator configured to rotate individual card substrates to a plurality of indexed angular orientations including a first orientation in which the card rotator is oriented to the processing path and a second orientation in which the card rotator is oriented to the auxiliary input path. In the method, an individual plastic card substrate is inserted through the auxiliary input. The card rotator is oriented to the second orientation and the plastic card substrate is delivered along the auxiliary input path into the card rotator. The plastic card substrate is then rotated using the card rotator to the first orientation and the plastic card substrate is processed using the processing device.

Other features and benefits that characterize embodiments of the present invention will be apparent upon reading the following detailed description and review of the associated drawings.

DETAILED DESCRIPTION OF ILLUSTRATIVE EMBODIMENTS

Embodiments of the present invention are generally directed to credential manufacturing devices and methods that use rigid or semi-rigid plastic card substrates. These plastic card substrates, as used herein, are of the type used to form identification cards and credit cards and are not suitable for use in paper sheet printers and copiers. That is, the plastic card substrates used in the credential manufacturing devices and methods of the present invention would likely become damaged using traditional sheet feed mechanisms that are configured to feed paper sheets and similar malleable substrates around various rollers.

Figure 1:
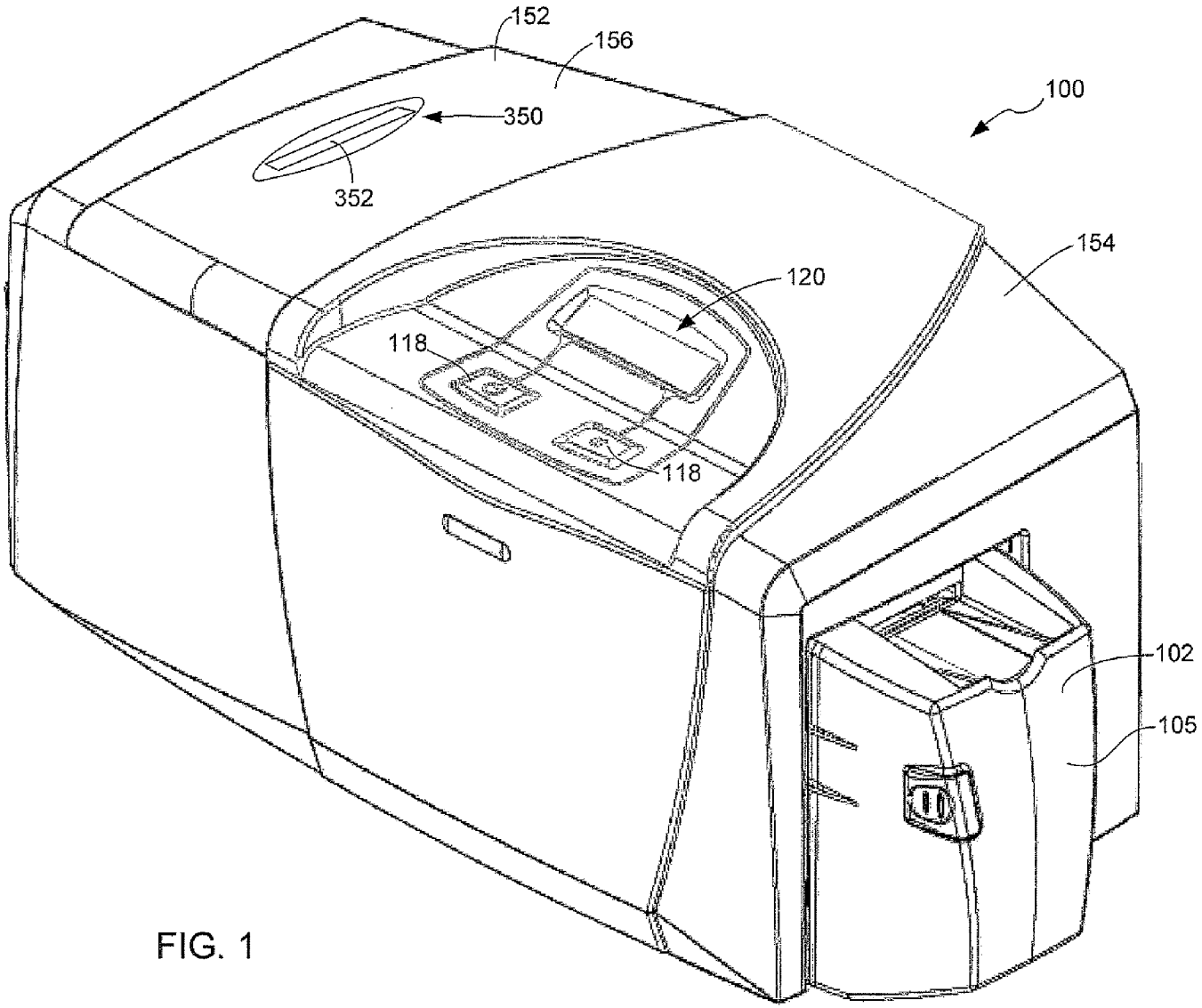
FIG. 1 is a perspective view of a credential manufacturing device in accordance with embodiments of the invention.
Figure 2:
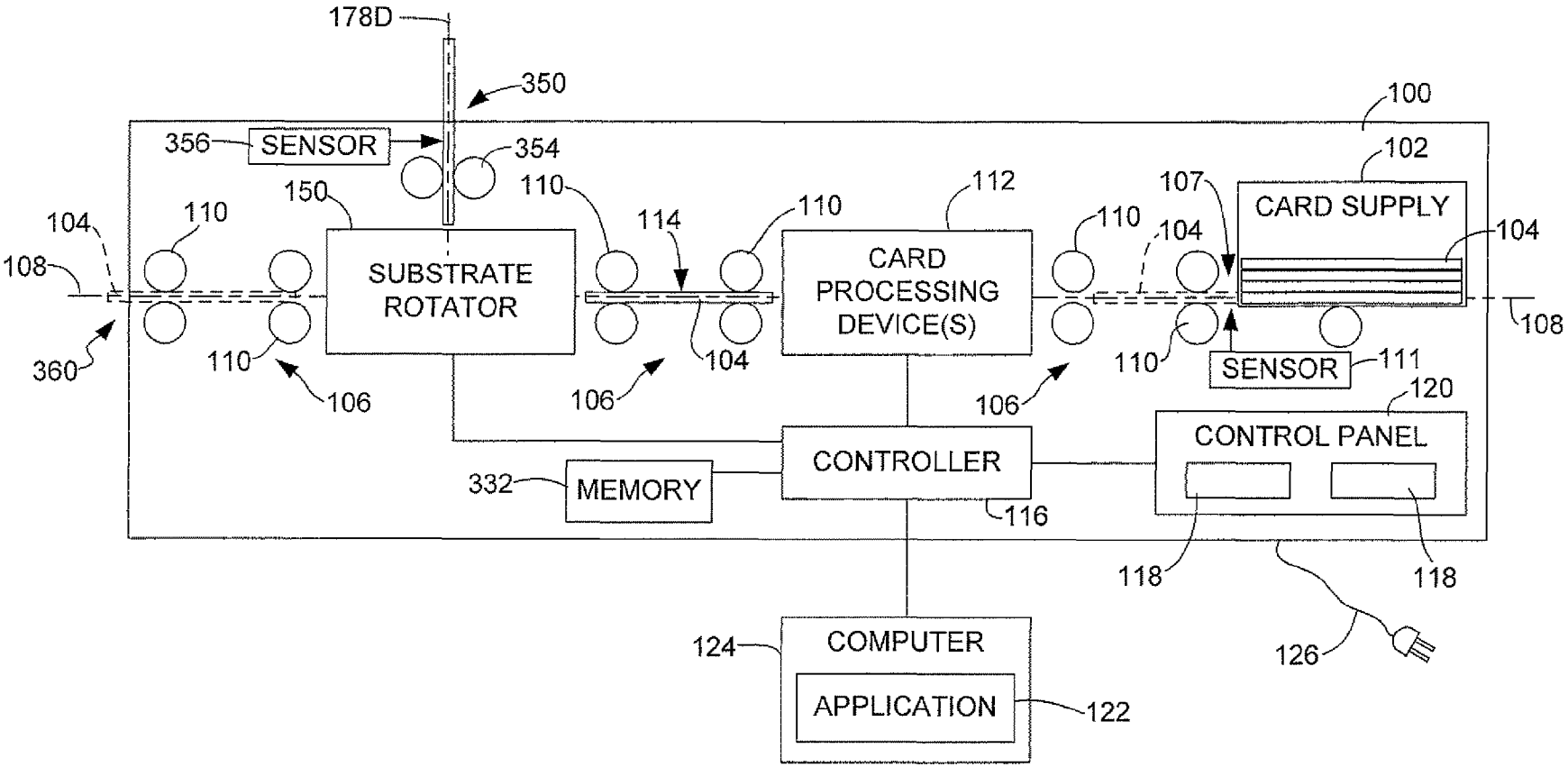
FIG. 2 is a schematic diagram of a credential manufacturing device in accordance with embodiments of the invention.

Embodiments of the present invention are generally related to a credential manufacturing device (CMD) 100, a perspective view of an exemplary embodiment of which is illustrated in FIG. 1. FIG. 2 is a schematic diagram of the CMD 100 in accordance with embodiments of the invention.

One embodiment of the CMD 100 includes a card supply 102 that is configured to hold a plurality of plastic card substrates 104, as shown in FIG. 2. The card supply 102 can include a card hopper or a card cartridge, such as cartridge 105 shown in FIG. 1.

A card transport mechanism 106 is configured to feed individual substrates 104 from the supply 102, which is positioned adjacent a main card input, and feed the substrates 104 through the main card input 107 and along a processing path 108. The main card input 107 generally designates the location where the individual card substrates 104 are received from the supply 102 for feeding along the processing path 108 and does not require a specific gate or other structure through which the card substrate 104 passes. Accordingly, the phrase "through a main card input" generally means that the card substrate passes the main card input location on its journey from the card supply 102 and along the processing path 108.

The card transport mechanism 106 can include, for example, motor-driven rollers including pinch roller assemblies, such as assemblies 110, or other substrate feeding components designed to feed the particular plastic card substrate 104 from the card supply 102 along the processing path 108. One embodiment of the CMD 100 includes a card sensor 111 configured to detect the feeding of a card substrate 104 from the card supply 102.

As mentioned above, the rigid or semi-rigid plastic card substrates 104 are susceptible to damage from excessive bending. As a result, the card transport mechanism 106 is designed to avoid such bending of the card substrate 104 as it is fed along the processing path 108. In one embodiment, the processing path 108 is substantially flat, as illustrated in FIG. 2. That is, the processing path 108 may contain slight bends that do not damage the card substrates 104, but lacks the significant bends of paper sheet feed mechanisms used in conventional paper sheet printers and copiers. Accordingly, those skilled in the art of credential manufacturing devices used to process the plastic card substrates 104 to form identification cards or credit cards understand that the card transport mechanism 106 of the present invention differs substantially from paper sheet feed mechanisms of paper sheet printers and copiers, that transport paper sheets and other highly malleable substrates through a path that includes many bends that are unsuitable for the plastic substrates 104 used by the CMD 100 of the present invention.

One embodiment of the CMD 100 includes at least one card processing device 112 configured to process the individual plastic card substrates 104 on the processing path 108. One embodiment of the card processing device 112 includes a print head configured to print an image to a surface, such as top surface 114, of the card substrate 104 that is delivered along the processing path 108 by the transport mechanism 106. The print head can be any conventional print head used in card manufacturing devices, such as a thermal print head or an ink jet printhead, for example. Exemplary card manufacturing devices that include such conventional print heads are described in U.S. Pat. Nos. 7,154,519 and 7,018,117 and U.S. application Ser. No. 10/647,666, each of which are incorporated herein by reference in their entirety.

Another embodiment of the card processing device 112 includes a conventional laminating roller that is configured to apply heat and pressure to an overlaminate film and a surface of the card substrate 104, such as surface 114, to laminate the overlaminate film to the surface of the card substrate 104 that is in the processing path 108.

Another embodiment of the card processing device 112 includes a conventional data writer or encoder that is configured to read and/or write data to the card substrate 104 that is in the processing path 108. Exemplary data writers or encoders include a magnetic stripe writer that is configured to write data to a magnetic stripe of the card substrate 104, a smart card writer that is configured to write data to memory of a smart card chip of the card substrate 104, and other conventional data writers of card manufacturing devices.

One embodiment of the CMD 100 includes one or more controllers, represented in FIG. 2 as controller 116. The controller 116 operates to control the operation of the CMD 100 including, receiving signals from sensors (e.g., sensor 111), controlling the card processing mechanism 112, the transport mechanism 106 and other components of the CMD 100 described below. In one embodiment, the controller 116 can be accessed directly by a user through buttons 118 on a control panel 120 of the device 100, or through a credential production application and/or driver software 122 running on a computer 124.

Power is preferably supplied to the CMD through a cable 126 connected to a line level power outlet. Alternatively, power can be supplied to the CMD 100 from a battery or other power supply.

Figure 3:
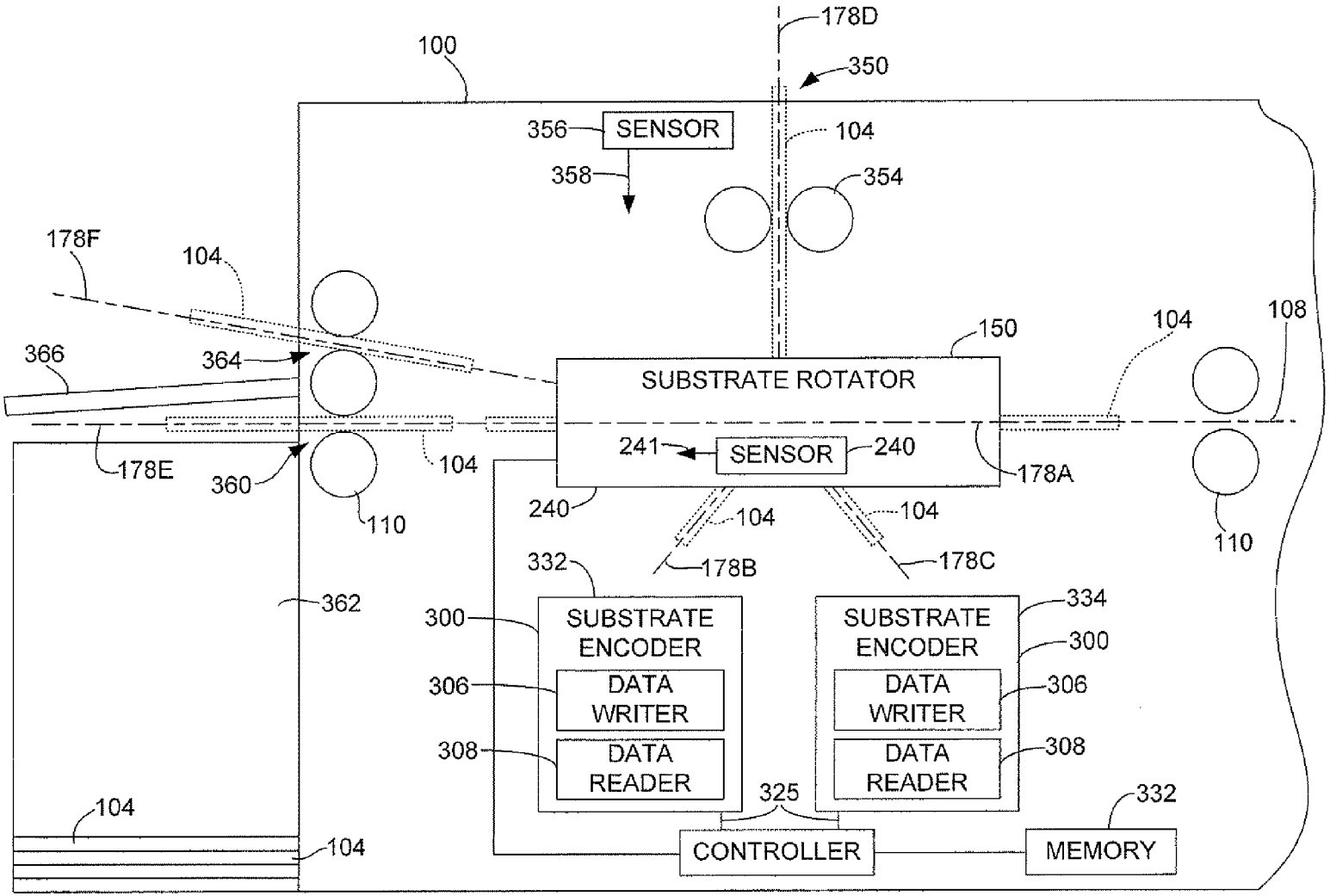
FIG. 3 is a schematic diagram of a credential manufacturing device in accordance with embodiments of the invention.

One embodiment of the CMD 100 includes a card rotator 150. FIG. 3 is a schematic diagram of a portion of the CMD 100 that includes the card rotator 150. In one embodiment, the card rotator 150 is included in a separate credential substrate processing module 152, shown in FIG. 4, that can be attached to the section 154 (FIG. 1) of the CMD 100 containing the card processing component 112 using brackets 155. The housing and cover 156, shown in FIG. 1, are removed in FIG. 3 to expose components of the module 152. A discussion of the optional modular arrangement of the CMD 100 is provided in U.S. patent application Ser. No. 11/222,505 filed Sep. 8, 2005, which is hereby incorporated herein by reference in its entirety.

In accordance with one embodiment, the card rotator 150 is configured to rotate individual card substrates 104 to a plurality of predefined or indexed angular positions or orientations. For example, the card rotator 150 can receive a substrate 104 being fed along the processing path 108 by the transport mechanism 106, invert the substrate 104 and provide the inverted substrate 104 to the transport mechanism 106 for delivery back to the card processing device 112 for additional processing. This allows for the processing (e.g., printing and/or laminating) of both sides of the card substrate 104. A discussion of the various orientations to which a card substrate 104 may be positioned in using the card rotator 150 will be provided below.

Figure 5:
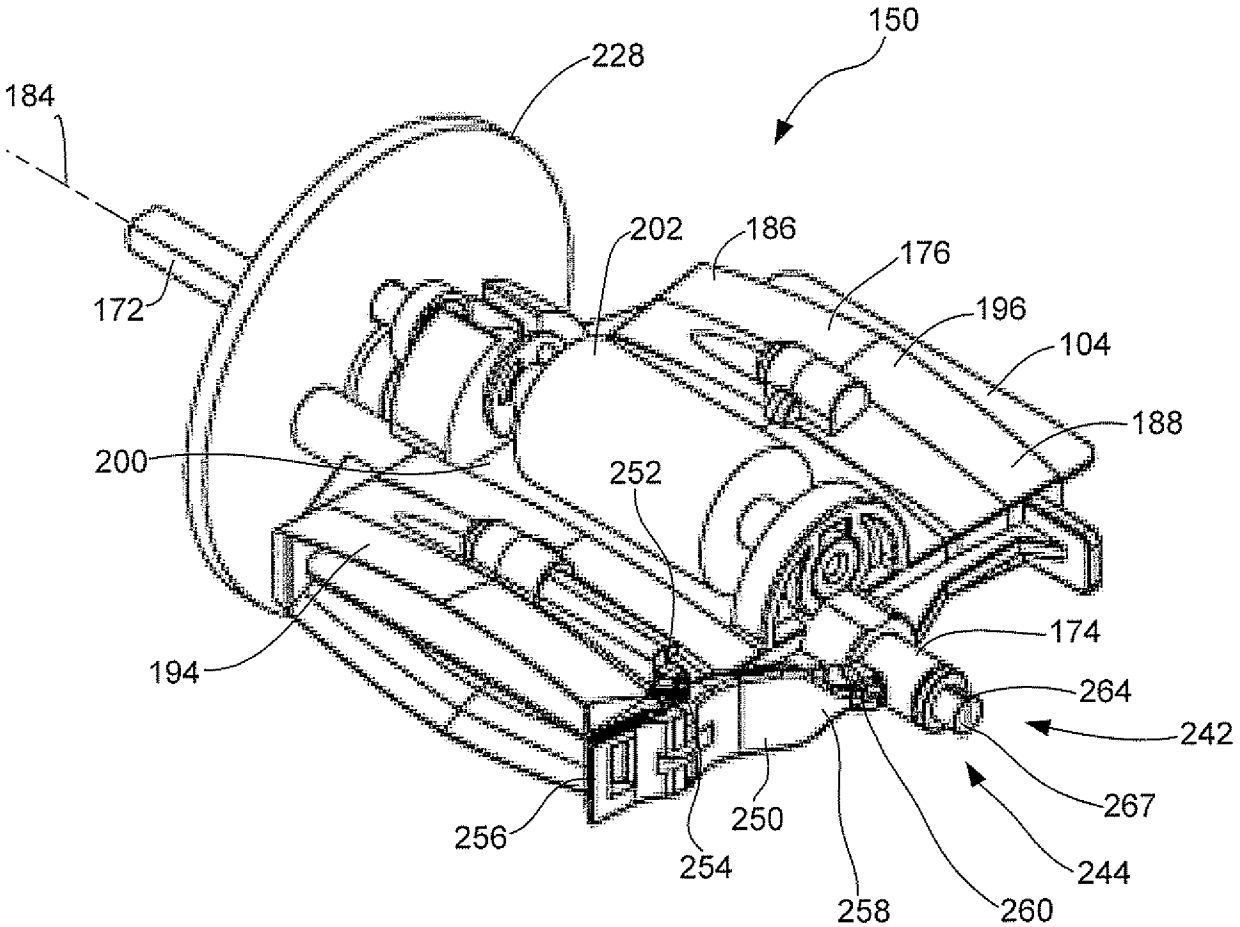
FIG. 5 is a perspective view of an exemplary card rotator in accordance with embodiments of the invention.
Figure 6:
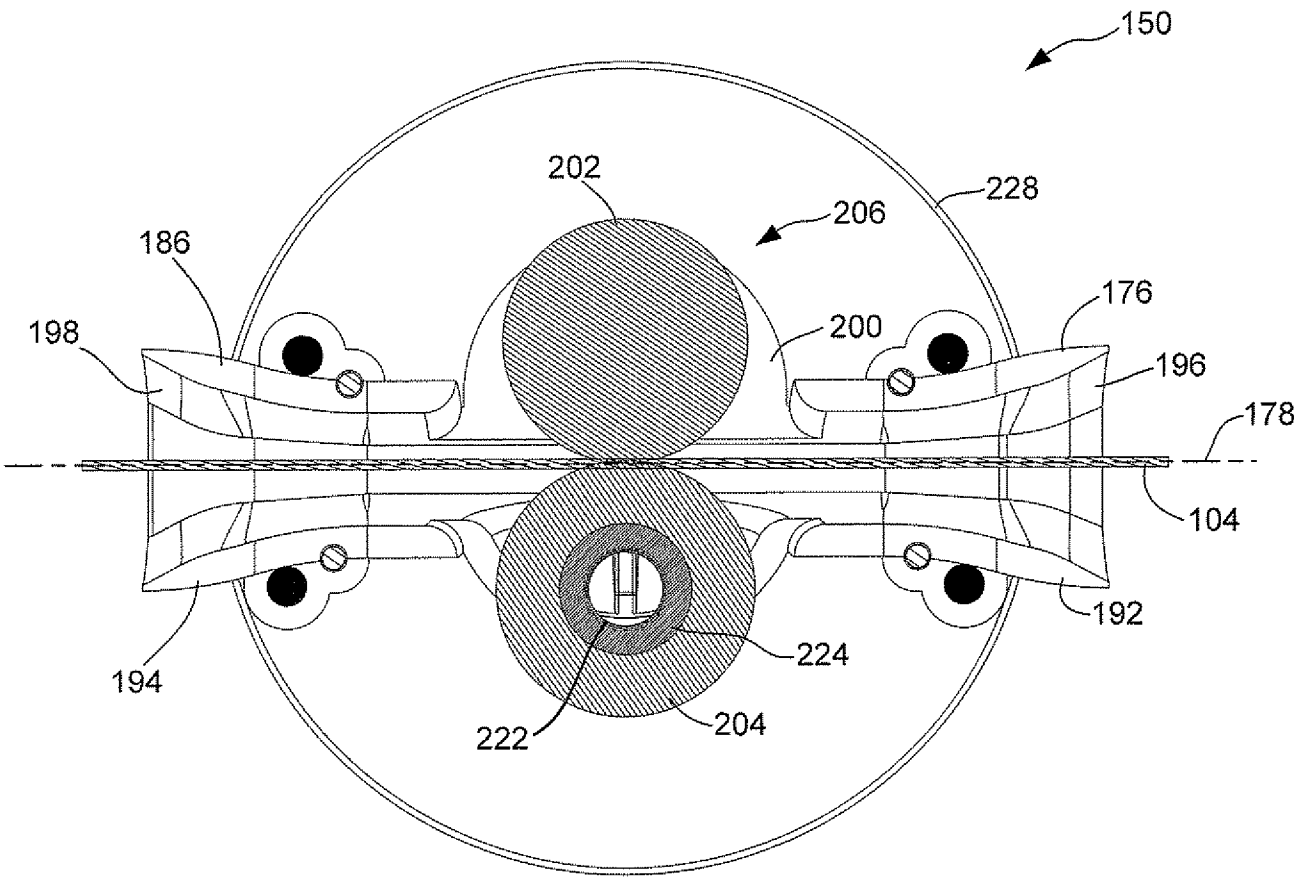
FIG. 6 is a side cross-sectional view of an exemplary card rotator in accordance with embodiments of the invention.
Figure 7:
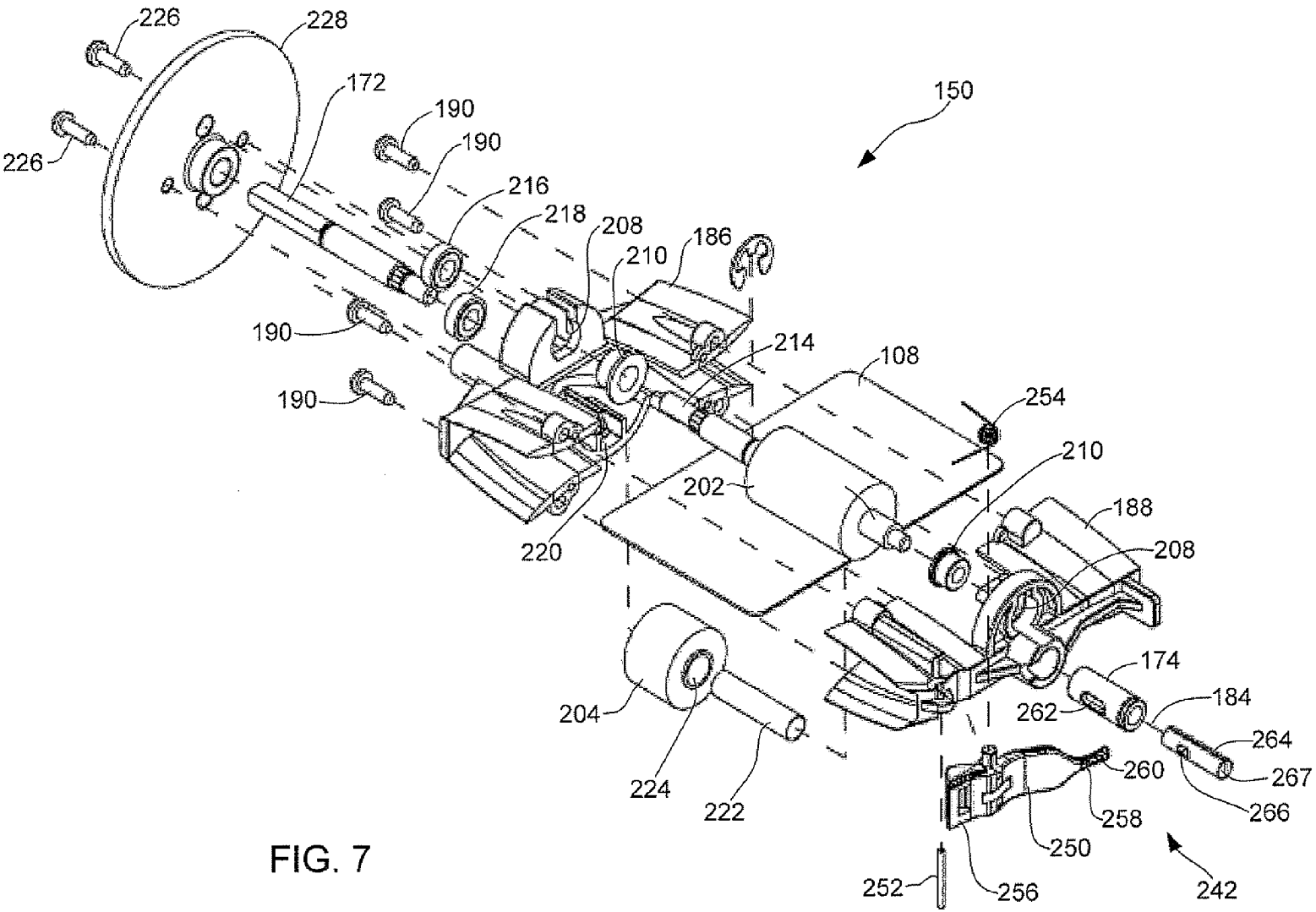
FIG. 7 is an exploded perspective view of an exemplary card rotator in accordance with embodiments of the invention.
Figure 8:
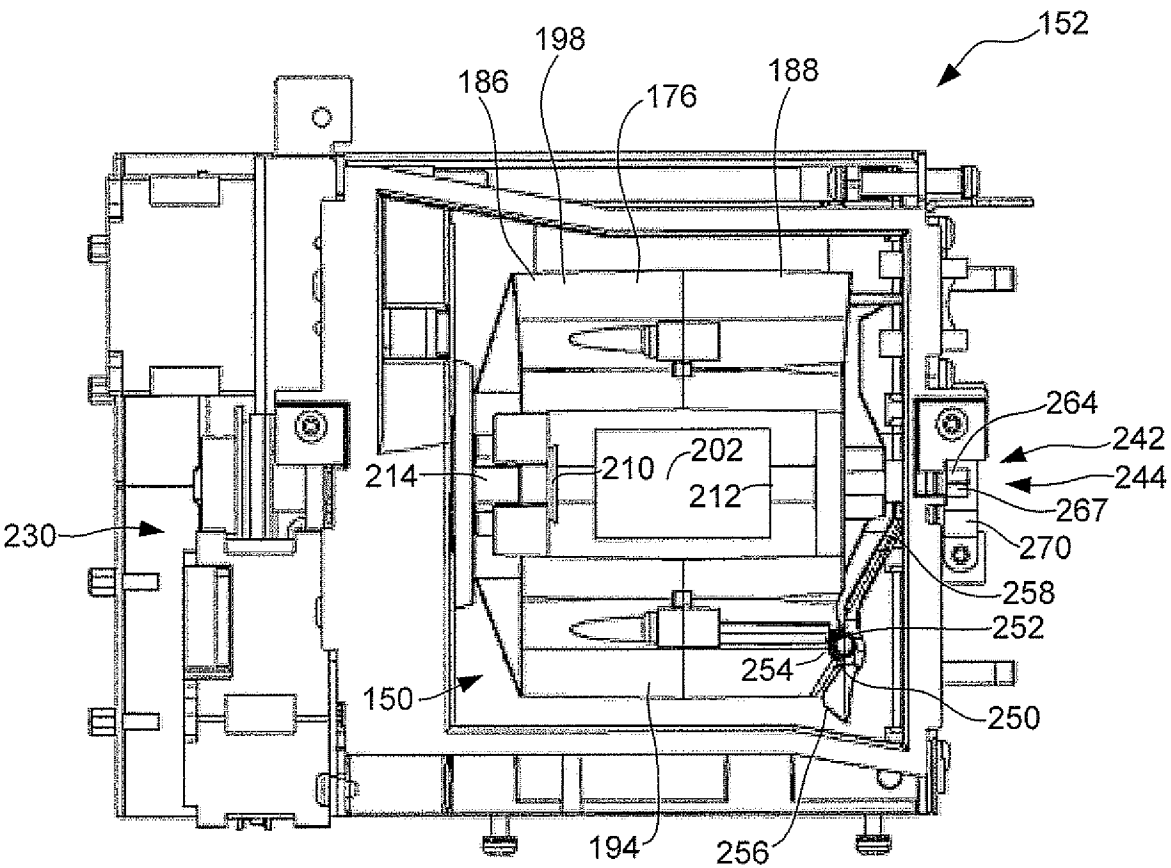
FIGS. 8 and 9 are top plan views of an exemplary card rotator in accordance with embodiments of the invention.
Figure 9:
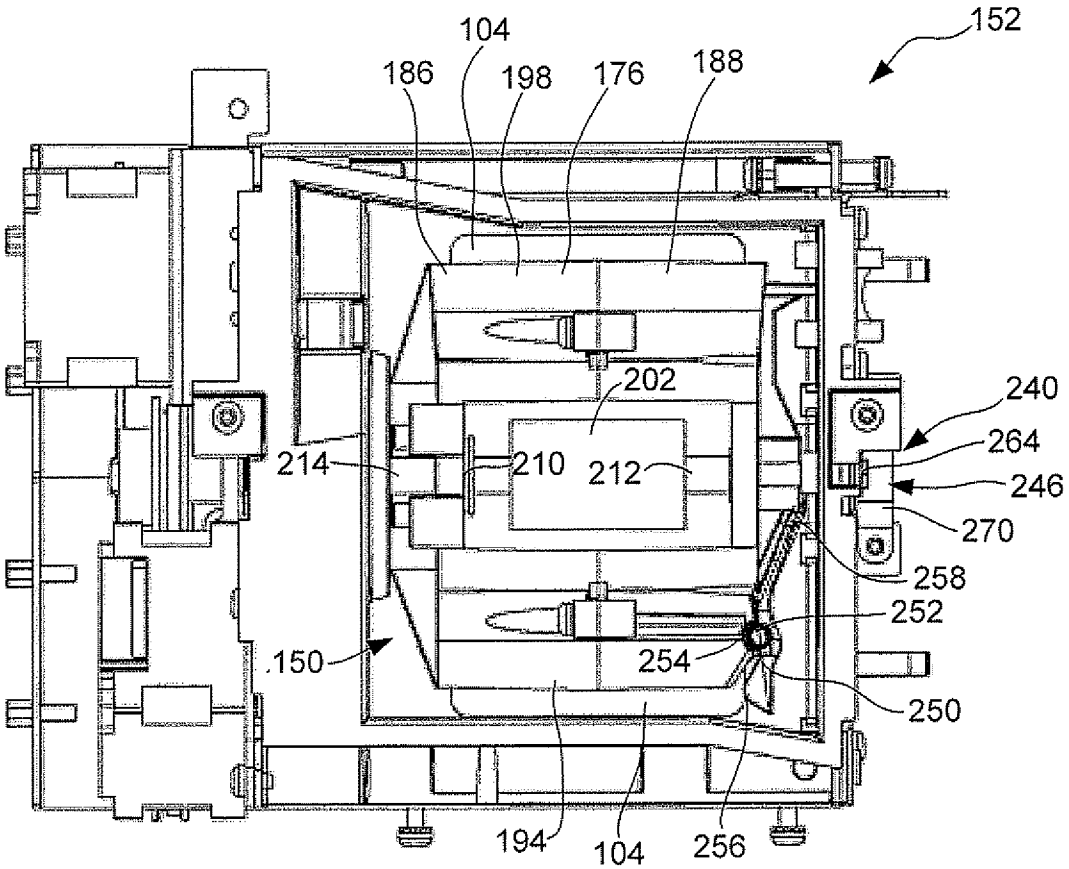

Perspective, side and exploded perspective views of an exemplary card rotator 150 in accordance with embodiments of the invention are respectively shown in FIGS. 5-7. FIGS. 8 and 9 are top plan views of the module 152 and the exemplary card rotator 150.

One embodiment of the card rotator 150 includes stub shafts 172 and 174 connected to a substrate support 176. The substrate support 176 defines a substrate support plane 178 (FIG. 6), in which the substrate 104 is supported and fed by the rotator 150. The stub shafts 172 and 174 are respectively supported between opposing side walls 180 and 182 shown in FIG. 4. The substrate support 176 rotates about a central axis 184 (FIG. 5) that is aligned with the stub shafts 172 and 174. In accordance with one embodiment of the invention, the central axis 184 extends through the substrate 104 supported by the substrate support 176. Accordingly, the substrate support plane 178 and any substrate 104 held within the substrate support 176 are rotated about the central axis 184 as the substrate support 176 is rotated.

One embodiment of the substrate support 176 includes first and second sections 186 and 188 that are joined together by screws 190. The substrate support also includes front and rear substrate guides 192 and 194 having flared ports 196 and 198, respectively, through which substrates 108 are received and discharged. A central opening 200 in the substrate support 176 accommodates a drive roller 202 and an idler pinch roller 204, respectively, which form a substrate feeder 206.

In one embodiment, the first and second sections 186 and 188 of the substrate support 176 each include a drive roller support 208 that is configured to receive a bearing or bushing 210, for rotatable support of a shaft 212 of the drive roller 202. One end 214 of the shaft 212 extends through the support 208 of the first section 186 and is attached to a gear 216 (e.g., a spur gear) that engages a gear 218, which is driven by a motor (not shown) driving stub shaft 172.

The first and second sections 186 and 188 of the substrate support 176 each include a pinch roller support 220 that is configured to receive ends of a spring member 222, which extends through a hub 224 of the pinch roller 204. The pinch roller 204 is configured to rotate about the spring member 222 and is biased by the spring member 222 toward the drive roller 202 for contact engagement therewith. Accordingly, the pinch roller 204 is configured for rotation and movement toward and away from the drive roller 202.

As a card substrate 104 is received between the drive roller 202 and the pinch roller 204, the pinch roller 204 pinches the substrate 104 against the drive roller 202 and the drive roller 202 either holds the substrate 104 in the substrate support plane 178, or is driven to feed the substrate 104 in the desired direction along the substrate support plane 178 while the pinch roller 204 responsively rotates in accordance with the direction the substrate 104 is driven. The pinching force applied by the pinch roller 204 to the substrate 104 is preferably sufficient to hold or clamp the substrate 104 in place.

The first section 186 of the substrate support 176 is attached with screws 226 or other means to a support gear 228, through which an end of the stub shaft 172 extends. The support gear 228 is driven by a motor for rotation about the stub shaft 172. The rotation of the support gear 220 rotates the substrate support 176 and a substrate 104 received between the drive and pinch rollers 202 and 204, about the central axis 184 that is co-axially aligned with the central axis 184 of the stub shafts 172 and 174, and is aligned with the central plane of the substrate 104 supported between the drive and pinch rollers 202 and 204.

Figure 4:
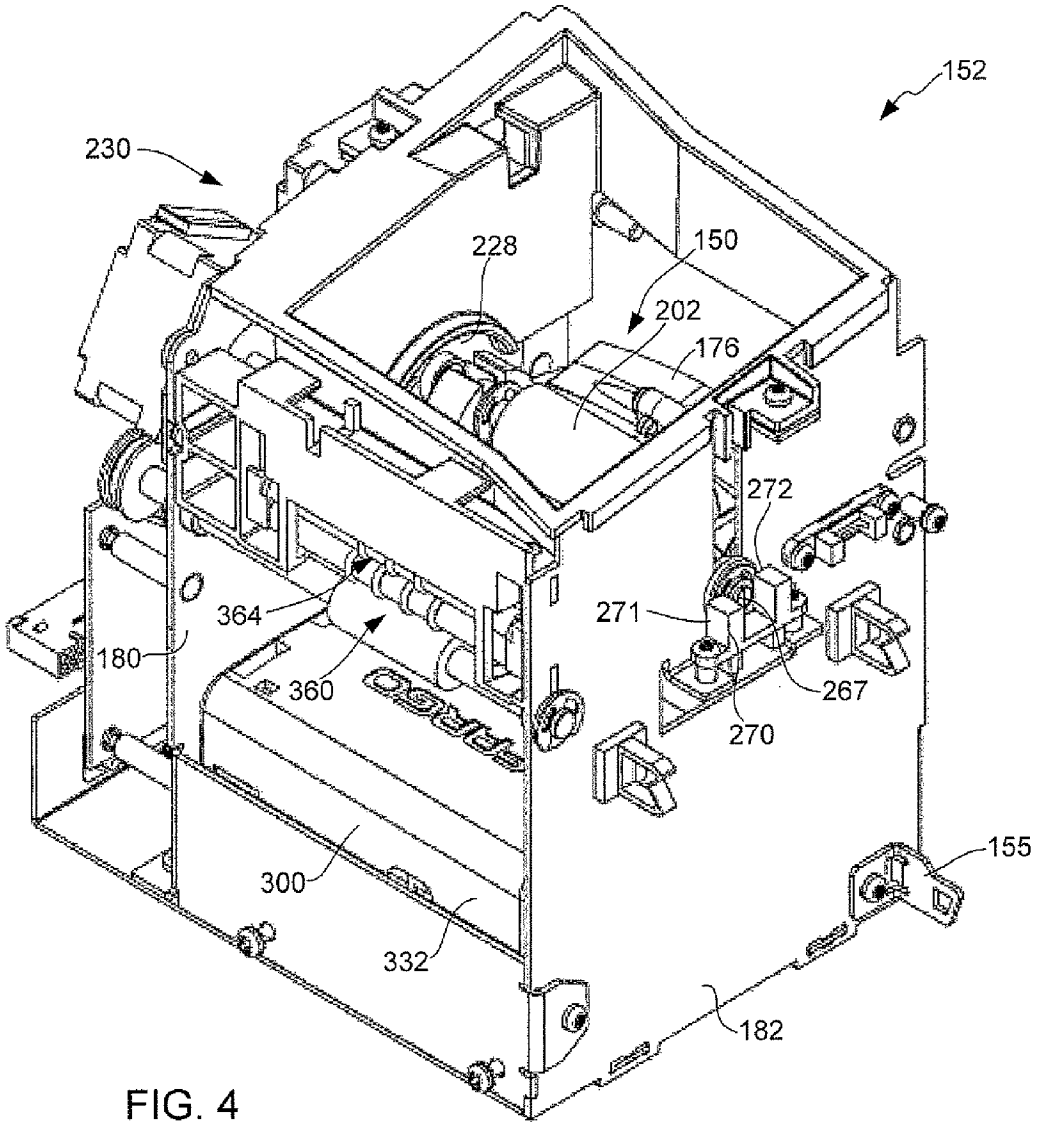
FIG. 4 is an isometric view of a credential manufacturing device with a housing and cover removed in accordance with embodiments of the invention.

The stub shaft 172 and the gear support 228 are driven by motors through an appropriate gear arrangement in a gear housing 230 (FIG. 4). The stub shaft 172 is received within the gear housing 230 and serves to drive the gear 218 to drive the gear 216, which in turn drives the shaft 212 of the drive roller 202. The stub shaft 172 is preferably driven by a stepper motor, or other suitable motor.

A stepper motor (not shown) is also preferably used for driving the gear support 228 in a suitable manner to rotate the attached substrate support 176 about the central axis 184. The stepper motor and the motor driving the stub shaft 172 are controlled by the controller 162 to rotate the substrate support 176 and the substrate support plane 178 in any desired angular position and to feed the substrate 104 relative to the substrate support 176 along the substrate support plane 178. In accordance with one embodiment of the invention, the drive roller 202 is rotated in the opposite direction of the rotation of the gear support 228 to maintain the substrate 104 in the center of the substrate support 176. For example, if the gear support 228 is rotated in a counterclockwise direction, the controller 162 drives the drive roller 202 in a clockwise direction to prevent the substrate 104 from moving relative to the substrate support 176. If the drive roller 202 was not driven in this manner, the gear 216 would roll over the gear 218 causing the drive roller 202 to rotate in the same direction (clockwise or counterclockwise) of the support gear 228 thereby moving the substrate 104 relative to the substrate support 176.

One advantage to maintaining the substrate 104 substantially in the center of the substrate support 176 during rotating operations, is that it reduces the space required to perform the substrate rotating operation. As a result, the size of the CMD 100 can be formed smaller than would be possible if the substrate 104 moved relative to the substrate support 176 during rotating operations.

One embodiment of the rotator 150 includes a substrate sensor 240 that detects the presence or absence of a card substrate 104 at a predetermined location relative to the substrate support 176 and produces an output signal 241 indicating such presence or absence of the card substrate 104, as shown in FIG. 3. The output signal 241 is provided to the controller 116, which uses the signal 241 to control operations of the card rotator 150. In general, once the controller 116 receives the signal 241 from the sensor 240 indicating that the card substrate 104 is fully loaded into the substrate support 176, rotating operations are allowed to commence.

Exemplary sensors 240 include optical sensors and other sensors that detect the presence of the card substrate 104 in the predetermined location relative to the substrate support 176. In one embodiment, the substrate sensor 240 utilizes an electrical connection, such as a slip ring connection, between the rotating substrate support 176 and the controller 116 to communicate the output signal 241 from the sensor 240 to the controller 162.

In accordance with another embodiment, the sensor 240 does not use such an electrical connection between the rotating support 176 and the non-rotating controller 116. In one exemplary embodiment, the substrate sensor 240 of the present invention comprises a mechanical switch 242 mounted to the substrate support 176 that is moved from a first position 244 (FIGS. 5 and 8) when the substrate 104 is not fully loaded into the substrate support 176 or is absent from the predetermined location, to a second position 246 (FIG. 9) when a substrate 104 is loaded into the substrate support 176 or is present in the predetermined location. Preferably, the switch 242 is moved to the second position 246 when the substrate 104 is fully seated in the desired position (e.g., centered) in the substrate support 176 between the driver and pinch rollers 202 and 204.

One embodiment of the switch 242 of the substrate sensor 240 includes a lever arm 250 that pivots about a pin 252 mounted to the second section 188 of the substrate support 176. A spring 254, or other suitable biasing member biases the lever 250 toward the first position 244, in which an end 256 protrudes into the substrate path or the support plane 178 and an opposing end 258 is displaced away from the second section 188 of the substrate support 176 along the central axis 184. The end 258 includes a protrusion 260 that extends through an opening 262 in the stub shaft 174 and is received by a pin trigger 264 in a notch 266. In accordance with one embodiment of the invention, the pin trigger 264 is coaxial with the central axis 184. The stub shaft 174 and the pin trigger 264 are configured to rotate with the substrate support 176 about the central axis 184. When the lever arm 250 is in the first position 244, a portion 267 of the pin trigger 264 extends outside of the stub shaft 174, as shown in FIGS. 5 and 9.

A pin sensor 270 (FIG. 3) detects the first or second position of the switch 242 and provides a signal indicating such to the controller 116. In accordance with one embodiment of the invention, the pin sensor 270 is a slotted optical sensor that includes a receiver 271 and an emitter 272, between which the portion 267 of the pin trigger 264 extends when the lever arm 250 is in the first position 244, as shown in FIGS. 5 and 9. The pin sensor 270 provides an output signal to the controller 116 that indicates the absence of the portion 167 of the pin trigger 264 from between the emitter and receiver of the pin sensor 270 thereby indicating the absence of a substrate 104 from the predetermined location of the substrate support 176.

As the substrate 104 is loaded into the substrate support 176 from the processing path 108, for example, the card substrate 104 engages the end 256 of the lever 250 and moves the end 256 out of the substrate path as the substrate 104 is driven by the drive roller 202 to move the lever 250 from the first position 244 toward the second position 246. The movement of the end 256 of the lever 250 causes the opposing end 258 and the connected trigger pin 264 to move along the central axis 184 such that the portion 267 of the pin trigger 264 is retracted within the shaft 174 and withdrawn from the pin sensor 270.

The output signal from the pin sensor 270 can then indicate that the switch 242 is in the second position 246 and that the substrate 104 is loaded into the substrate support 176 at the predetermined location of the substrate support 176. Once the controller 116 receives the signal from the pin sensor 240 that the substrate 104 is loaded into the substrate support 176, rotating operations are allowed to commence.

In accordance with another embodiment, the CMD 100 includes one or more data encoders 300, as shown in FIG. 3. The data encoders 300 can each be located in one of a plurality of bays in the housing of the CMD 100 or module 152, such as bay 302 or bay 304. As shown in FIG. 3, each data encoder 300 can include a data writer 306 configured to write data to a memory chip, a bar code, or other component of the substrate 104, and a data reader 308 configured to read data from the substrate 104, in accordance with known methods.

Figure 10:
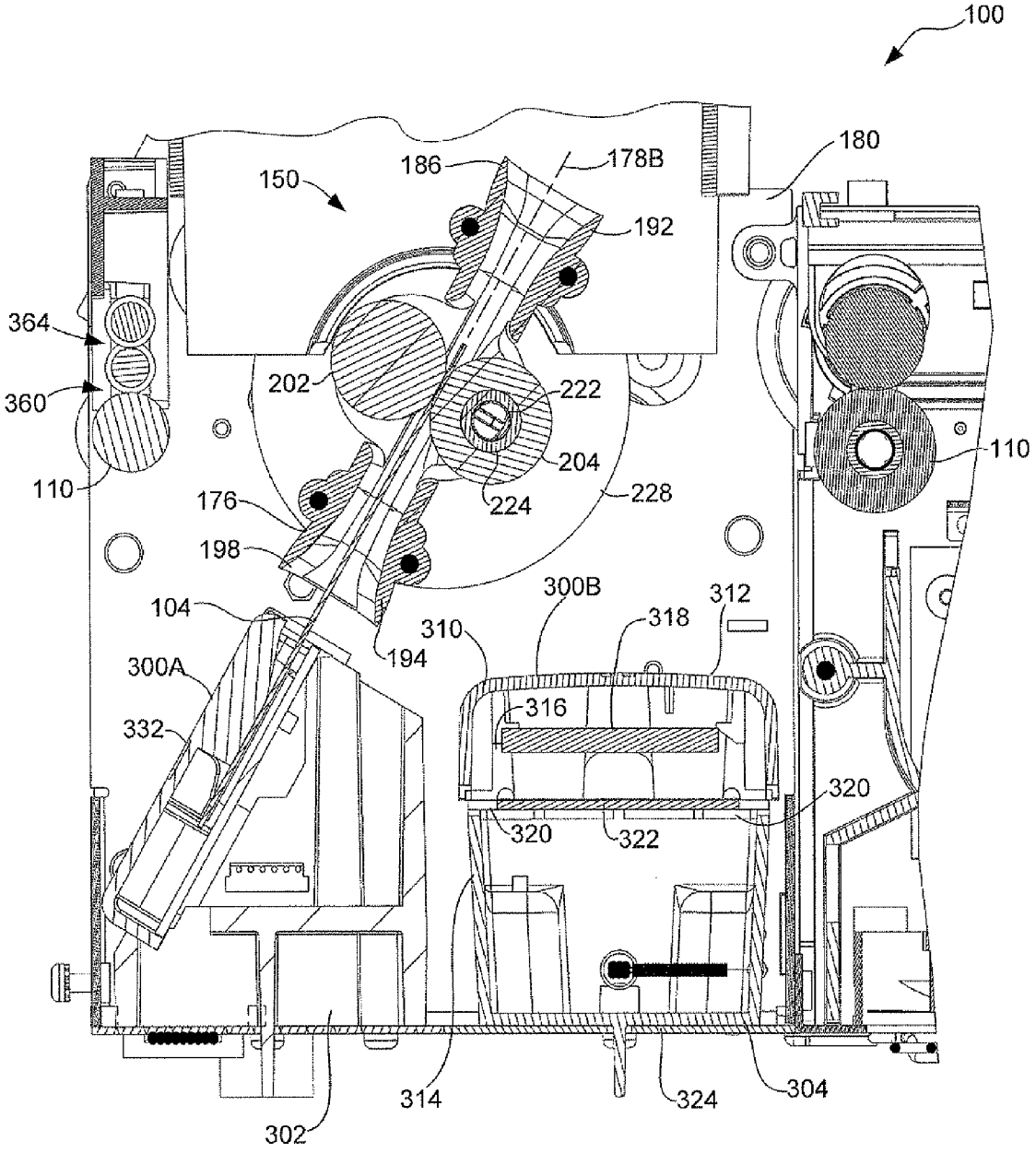
FIGS. 10-15 are side cross-sectional views of an exemplary card rotator and other components of the credential manufacturing device in accordance with embodiments of the invention.

Embodiments of the encoders 300 include, for example, a contact encoder 300A (FIG. 10) configured to encode the substrate 104 through direct contact and a proximity encoder 300B (FIG. 10) configured to perform proximity or radio frequency encoding of the substrate 104 as shown in FIG. 10. The encoding can be conducted in accordance with a standardized method such as, for example, HID®, iCLASS™, MIFARE, Legic, or other encoding method.

One embodiment of the encoders 300 includes a housing 310 that is configured to contain the circuit boards and components of multiple types of proximity encoders and readers. For example, one housing 310 can contain an HID® iCLASS proximity encoder and reader boards, MIFARE proximity encoder and reader boards, or Legic proximity encoder and reader boards. Such a housing 310 provides a cost savings since there is no need to produce multiple housing types. Additionally, the single standardized housing 310 simplifies the installation of the encoders 300 in the module X.

One embodiment of the housing 310, shown in FIG. 10, includes a bottom portion 312 and a top portion 314 that is configured to snap-fit to the bottom portion 312. Shoulder portions within the housing 310 provide support for the proximity encoding and reading boards. In accordance with one embodiment of the invention, the housing 310 includes multiple shoulder portions to accommodate the different types of boards in different locations within the housing 310. For example, shoulder portions 316 can be positioned and the interior of the housing 310 can be shaped, to receive an iCLASS board 318, whereas shoulder portions 320 can be positioned and the interior of the housing 310 can be shaped, to receive a MIFARE board 322, as shown in FIG. 10.

In accordance with another embodiment of the invention, the housing 310 includes a base plate 324. The base plate 324 covers an opening of the bay 304 of the housing when the encoder 300 is installed.

Cables 325, depicted schematically in FIG. 3, connect the encoder modules 300 to the controller 116 to provide a communication link therewith. Power can also be supplied through the cables. In accordance with one embodiment of the invention, the cables 325 connecting the encoder modules 300 to the controller 116 are multi-pin (e.g., 8-pin) cables. Identification of the particular encoder 300 that is installed is automatically determined based upon the pins that are active/ inactive in the cable 325. This can be accomplished using a look-up table contained in memory 326, or other suitable method. As a result, one embodiment of the invention includes a "plug and play" feature that quickly identifies the setup of the encoders 300 for the controller 116 and/or the application or driver software 122.

Instructions for rotating a card substrate 104 that is loaded into the card rotator 150, such as in the substrate support 176, are generally provided by the substrate processing job generated by the credential production application or driver software 122. The substrate processing job can include, for example, printing instructions, laminating instructions, encoding instructions, rotating instructions, and other substrate processing instructions. Such instructions are stored in a tangible medium and executable by a microprocessor including, for example, the controller 116.

As discussed above, the card rotator 150 is configured to rotate a received substrate 104 to a plurality of predefined angular positions or orientations under the control of the controller 116. In accordance with the exemplary card rotator 150 described above, this rotation is represented by the rotation of the substrate support plane 178, which corresponds to the plane of the substrate 104 when received in the card rotator 150. While discussions below reference rotations and orientations of the substrate support plane 178, it is understood that the present invention is not limited to the exemplary card rotator 150 described in detail above. Accordingly, while the discussion below may refer directly to the card rotator 150 described in detail above, embodiments of the invention include the use of any suitable card rotator that is capable of rotating an individual card substrate 104 (represented by the rotation of the plane 178) to one or more of the predefined or indexed angular positions or orientations (178) described below.

Figure 12:
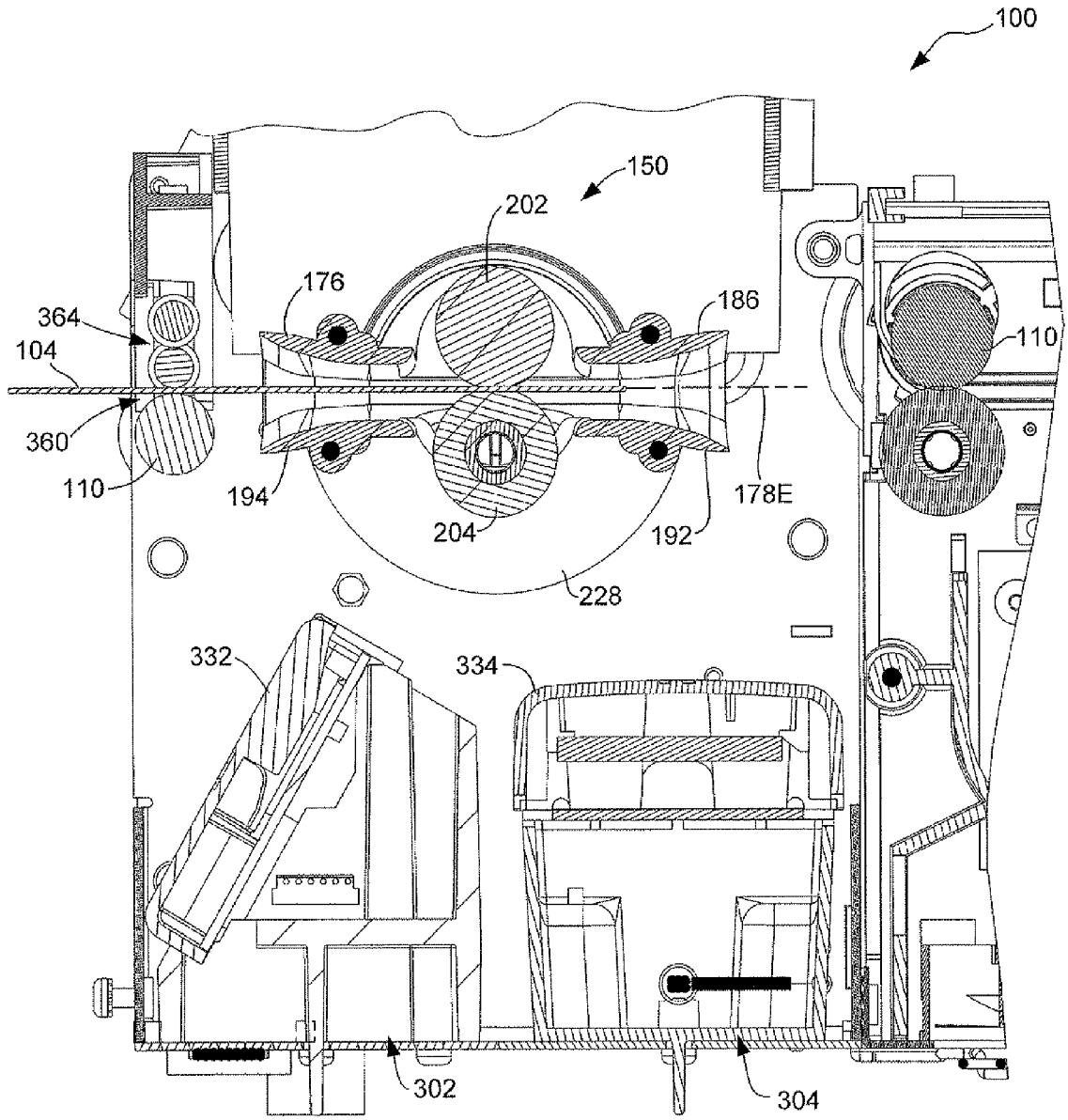

In accordance with one embodiment, the card rotator 150 is configured rotate to the orientation represented by plane 178A (FIGS. 3 and 12) for alignment with the processing path 108. When aligned with the plane 178A, the card rotator 150 can receive a card substrate 104 fed by the transport mechanism 106 along the processing path 108 by, for example, driving the substrate 104 into the substrate support 176 using the drive roller 202 until the substrate sensor 240 indicates receipt of the substrate 104 (e.g., the switch 242 moves from the first position to the second position). Additionally, the substrate rotator 150 may discharge a card substrate 104 that is received in the card rotator 150 to the card transport mechanism for feeding along the processing path 108.

A substrate inversion is performed by rotating a card substrate 104 received in the card rotator 180° such that the plane 178 is substantially realigned with the substrate receiving position 178A. The substrate 104 can then be fed back along the processing path 108 to the processing component 112 for additional processing. For instance, a 180° rotation, or inversion, of the substrate 104 can be performed by rotating the gear support 228 180°. Preferably, the gear support 228 is indexed to provide accurate angular substrate positioning. The substrate 104 is then discharged by driving it past the end 256 of the lever 250 of the switch 242 where it is detected by the substrate sensor 330 and received by the transport mechanism 106 of the CMD 100. Additional processing of the substrate 104, such as printing, can then be carried out on the substrate 104.

Figure 11:
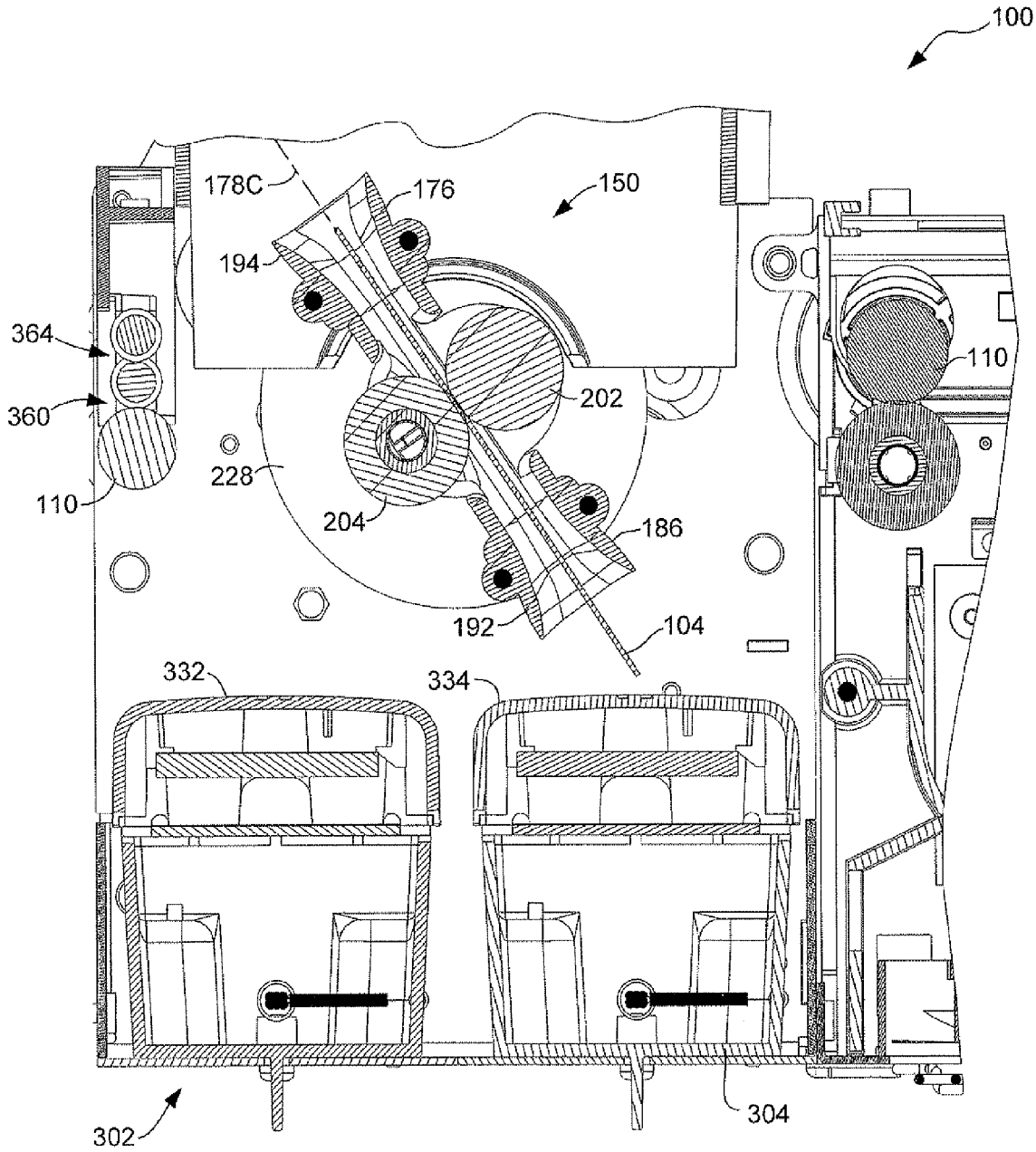

Additionally, the rotator 150 can be used to direct the substrate 104 toward one or both of the encoding modules 300 to perform encoding operations on the substrate 104. In one embodiment, the card rotator 150 can rotate a received substrate 104 to a first encoding position or path, indicated by substrate support plane 178B (FIGS. 4 and 10), to align the card substrate 104 for encoding with the encoder 332, as shown in FIG. 3. Likewise, in another embodiment, the card rotator 150 can rotate the card substrate 104 in alignment with a second encoding position or path, indicated by substrate support plane 178C (FIGS. 4 and 11), for encoding the card substrate 104 with the encoder 334, as shown in FIG. 3. After the substrate 104 is rotated to the desired angular position corresponding to the encoder 300 to be used, the substrate 104 can be fed toward the encoder 300 along the desired encoding path 178B or 178C by the feeder 206 or other feed mechanism, if necessary, to position the substrate 104 for encoding. FIG. 10 illustrates the rotation and insertion of the substrate 104 within the contact encoder 300A for contact smart chip encoding. FIG. 11 illustrates the rotation of the substrate 104 and the feeding of the substrate 104 toward the proximity encoder 300B for a wireless encoding of the smart chip of the substrate 104.

One embodiment of the CMD 100 includes an auxiliary input 350, shown in FIGS. 1-3 and 15, through which individual card substrates 104 can be fed, such as by hand, for processing by the CMD 100. Thus, the auxiliary input 350 allows an operator to process a card substrate 104 without having to load the substrate 104 in the card supply 102. This allows the operator to conveniently process a card substrate 104 that may be different than those contained in the card supply 102, for example. Also, the operator can send a processed card 104 back into the CMD 100 to read the data stored on the card using the data reader 308 of one of the data encoders 300, perform a data write operation on the card using the data writer 306 of one of the encoders 300, or perform another operation on the card.

Figure 15:
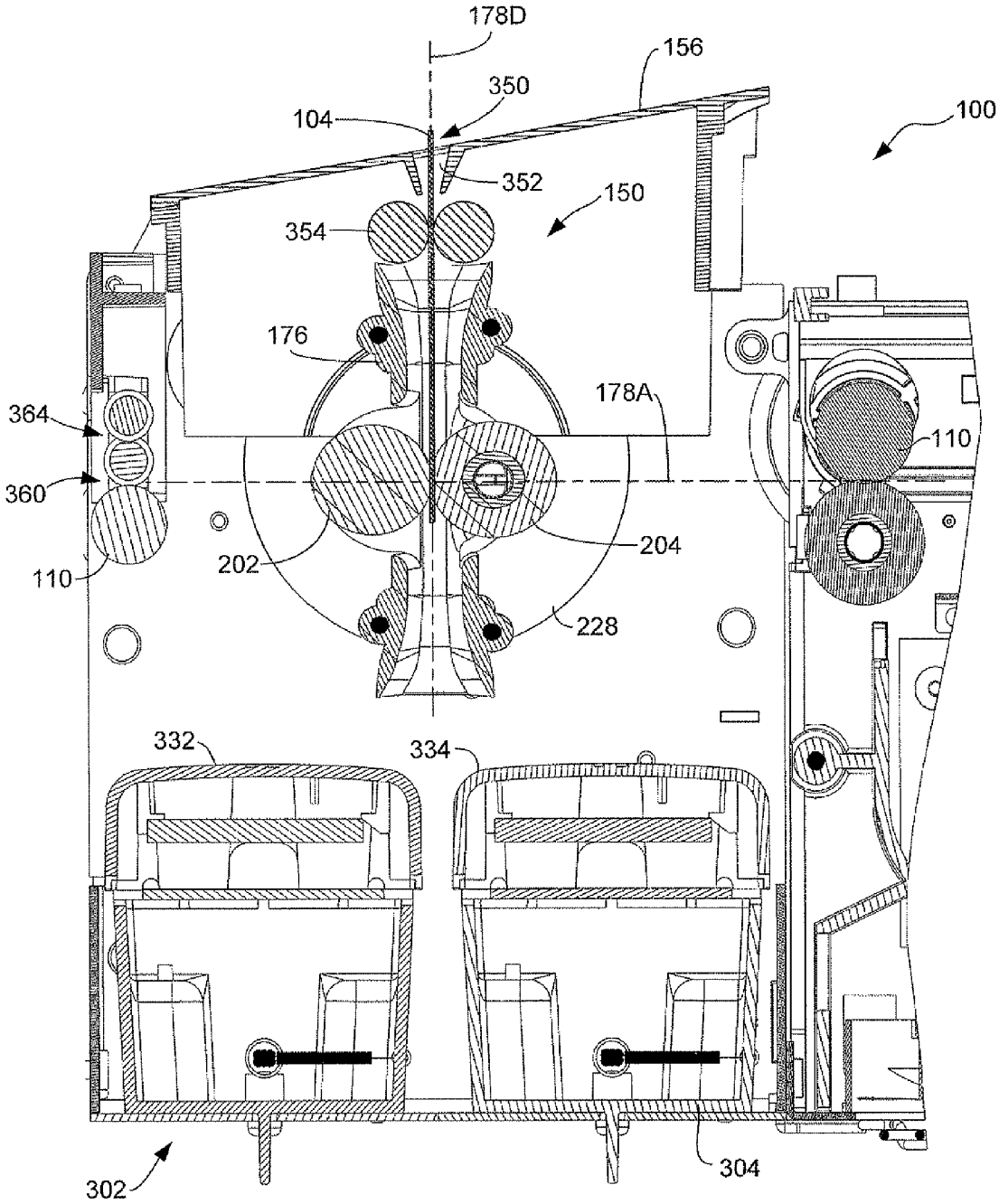

The auxiliary input 350 receives individual card substrates 104 through, for example, a slot 352 in the housing 156 of the CMD 100, for travel along an auxiliary input path represented by plane 178D (FIGS. 3 and 15). In one embodiment, a pair of feed or guide rollers 354 are positioned to feed or guide a card substrate 104 input through the auxiliary input 350 along the auxiliary input path 178D. In one embodiment, the auxiliary input path 178D is transverse to the processing path 108 (178A). The term "transverse", as used herein, indicates that the auxiliary input path 178D could be perpendicular or oblique to the processing path 108 (178A). In another embodiment, the auxiliary input path 178D is approximately perpendicular to the processing path 108. In one embodiment, the auxiliary input path 178D is substantially flat.

In one embodiment, a sensor 356 (FIGS. 2 and 3), such as a slotted optical sensor, detects when a card substrate 104 is received at the auxiliary input and generates a signal 358 that is fed to the controller 116 to indicate the reception of the card substrate 104 at the auxiliary input 350. When the signal 358 indicates insertion of a card substrate 104 at the auxiliary input 350, the controller 116 may complete any current card substrate processing being performed by the CMD 100 prior to receiving the card substrate 104 at the auxiliary input 350.

In one embodiment, the reception of the card substrate 104 at the auxiliary input 350 involves orienting the card rotator 150 with the auxiliary input path 178D to receive the input substrate 104 by, for example, rotating the substrate support 176 to align with the plane 178D of the auxiliary input path, as shown in FIG. 15. The card substrate 104 can then either be fed by hand into the auxiliary input 350 by the operator until gripped by the card rotator 150, or fed into the card rotator 150 by motorized feed rollers 354, for example.

Figure 14:
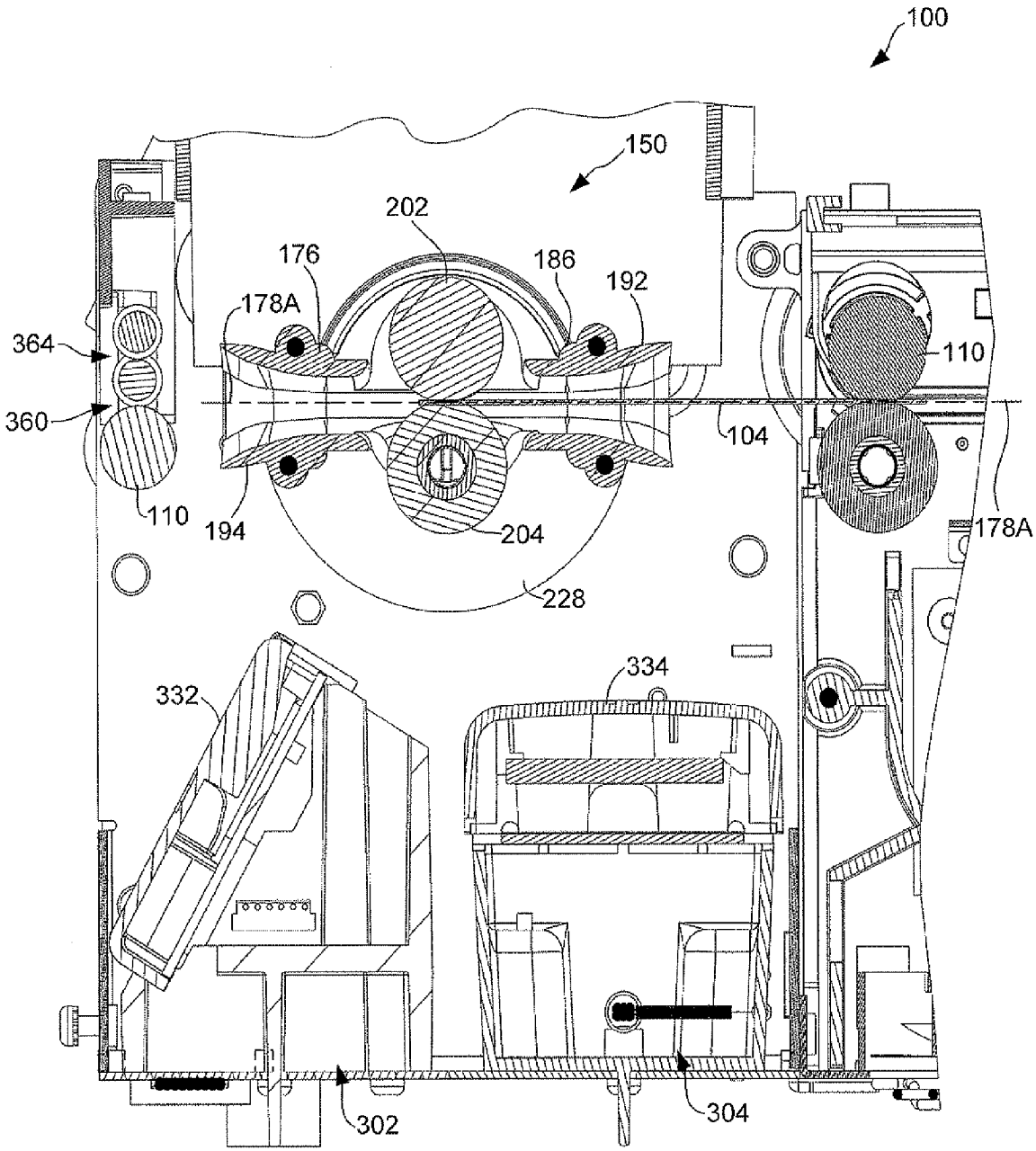

Once the card substrate 104 is received within the card rotator 150, the card rotator 150 can rotate the orientation of the card from the auxiliary input path 178D to any one of the other predefined or indexed angular positions. For example, the card rotator 150 can orient or align the card 104 to the plane 178A for feeding along the processing path 108 and for processing by the one or more card processing devices 112 (FIG. 14) or align the card 104 to the planes 178B or 178C for processing by one of the encoders 300 (FIGS. 10 and 11).

In accordance with another embodiment, the CMD includes a card output 360 at an end of the processing path 108 that is opposite the card supply 102. Processed card substrates 104 are discharged through the card output 360. In the exemplary configuration of the CMD 100 illustrated in FIG. 2, the card rotator 150 orients the a received card 104 in line with the plane 178E for feeding through the card output 360.

In accordance with one embodiment of the invention, the card rotator 150 includes different indexed angular positions for discharging correctly processed substrates 104 and incorrectly or incompletely processed card substrates 104. The user may select the desired discharge option via the software driver, or other method. When the card substrate 104 has been correctly processed, the card rotator 150 orients the card substrate 104 to a substrate collection output position, indicated by the plane 178E (FIGS. 3 and 12), which aligns the card substrate 104 with the card output 360. In accordance with one embodiment of the invention, the substrate collection output position 178D is coplanar with the substrate receiving position 178A and the processing path 108, as shown in FIG. 3. The card substrate 104 can then be fed or discharged through the card output 360 for collection in an optional hopper 362 (FIG. 3). In accordance with another embodiment, the processed substrate 104 may be rotated in alignment with the auxiliary input path 178D and discharged through the auxiliary input 350.

Figure 13:
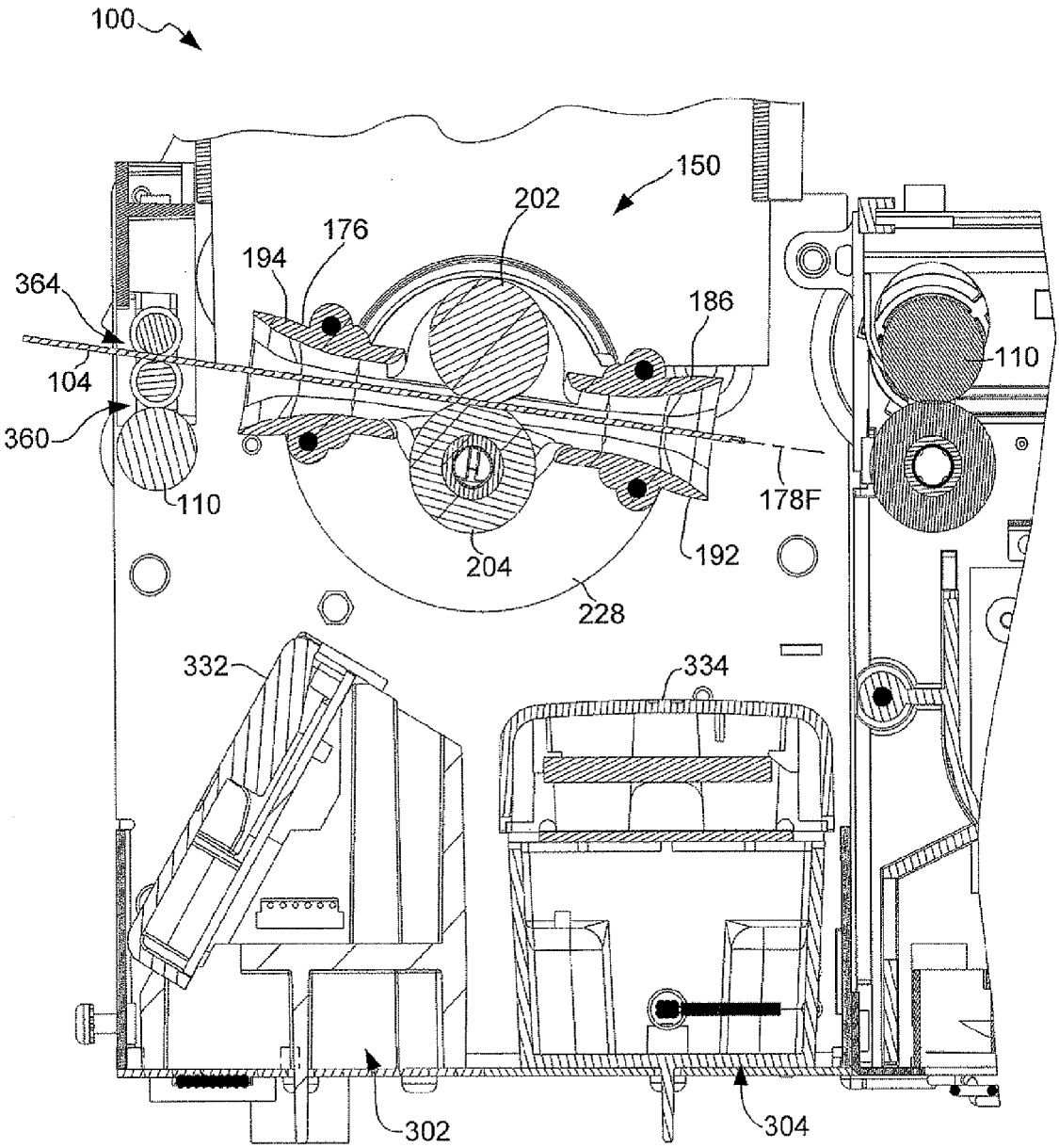

When the substrate 104 has not been correctly processed, the card rotator 150 can rotate the card substrate 104 such that it is oriented to a substrate reject output position, indicated by the plane 178F (FIGS. 3 and 13), which is aligned with a substrate reject output 364. The substrate 104 can then be fed or discharge through the substrate reject output 364 for collection in an optional reject tray or hopper 366, shown in FIG. 3.

Figure 16:
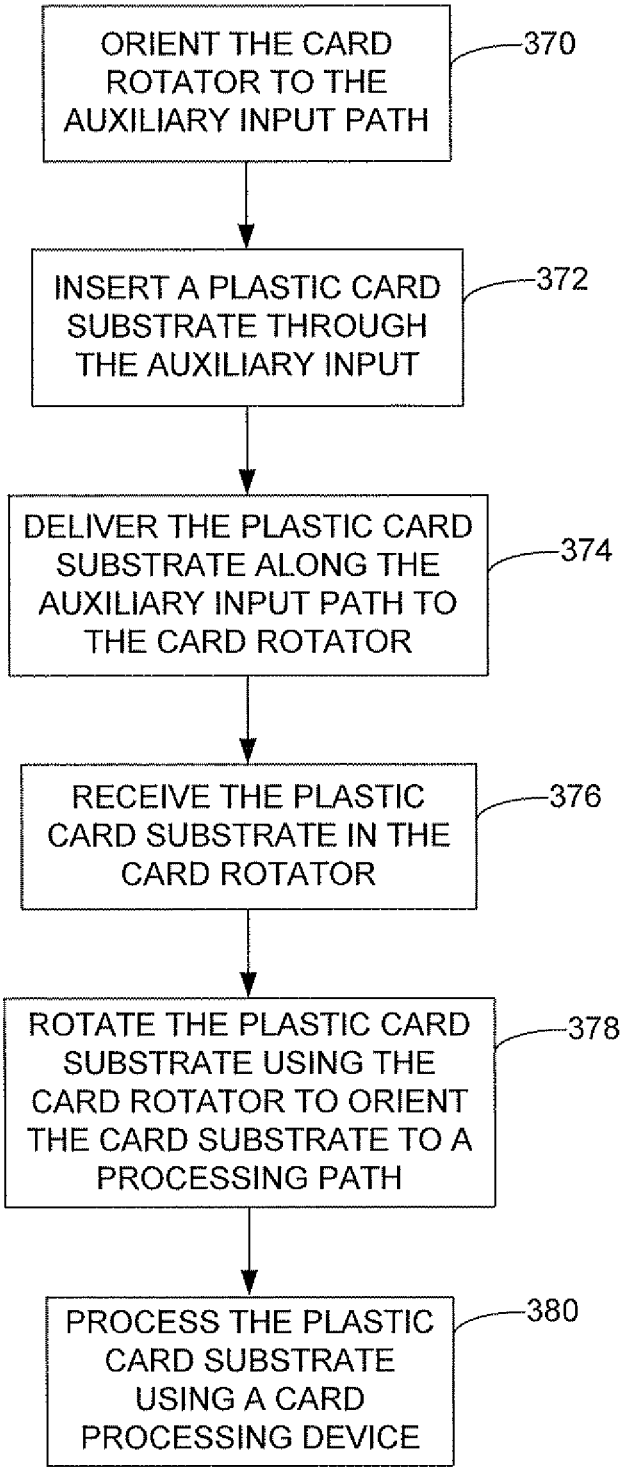
FIG. 16 is a flowchart illustrating a method of processing a plastic card substrate using the credential manufacturing device, in accordance with embodiments of the invention.

Additional embodiments of the invention are directed to methods of processing the plastic card substrates 104 using embodiments of the credential manufacturing device 100 described above. One embodiment of the method is illustrated in the flowchart of FIG. 16. At step 370, the card rotator 150 is oriented to the auxiliary input path 178D (FIGS. 3 and 15) and a plastic card substrate 104 is inserted through the auxiliary input 350, at step 372, as shown in FIGS. 2, 3 and 15. At step 374, the plastic card substrate 104 is delivered along the auxiliary input path 178D to the card rotator 150 and the plastic card substrate 104 is received in the card rotator 150 at step 376.

At step 378, the plastic card substrate 104 is rotated using the card rotator 150 to orient the card substrate 104 to a processing path. Embodiments of the processing path include processing path 108, encoding path 178B and encoding path 178C, for example.

At step 380, the plastic card substrate 104 is processed using a card processing device. In one embodiment, the particular card processing device used to process the card substrate 104 includes the one or more card processing devices 112, which are in line with the processing path 108. The term "in line", as used herein, means that the one or more devices 112 are positioned such that they can process the card substrates 104 that are in the processing path 108. For example, when the card processing device 112 includes a print head, step 380 can include printing an image to a surface of the card substrate 104, such as surface 114, shown in FIG. 2. Similarly, when the card processing device 112 includes a laminating roller, one embodiment of step 380 comprises laminating an overlaminate material to a surface of the plastic card substrate 104, such as surface 114. When the card processing device 112 includes a data writer or substrate encoder, step 380 includes writing data to the plastic card substrate 104, such as to a magnetic strip of the card substrate 104 or to a memory of the card substrate 104.

In another embodiment, when the plastic card substrate 104 is rotated to one of the encoding paths 178B or 178C, step 380 involves writing and/or reading data to the card substrate using one of the encoders 300, as described above.

In accordance with another embodiment of the method, the plastic card substrate 104 is discharged through the card output 360 after the processing step 380.

In accordance with one embodiment of the method, another plastic card substrate 104 is fed from the card supply 102 along the processing path 108 after the processing step 380. Next, a process is performed on the card substrate 104 using one of the card processing devices 112. In one embodiment, the card processing devices 112 include a print head and an image is printed on the surface of the second plastic card substrate 104 using the print head. Finally, the second card substrate 104 is discharged through the card output 360 that is positioned at an end of the card manufacturing device 100 that is opposite the card supply 102.

Although the present invention has been described with reference to preferred embodiments, workers skilled in the art will recognize that changes may be made in form and detail without departing from the spirit and scope of the invention. For example, it should be understood that the present invention includes the embodiments described above taken individually and in combination with one or more of the other embodiments of the invention.

What is claimed is:

1. A credential manufacturing device comprising:

a card supply positioned adjacent to a main card input and configured to hold a plurality of plastic card substrates;

a card transport configured to feed individual card substrates from the card supply through the main card input and along a processing path;

a card processing device selected from the group consisting of a print head and a laminating roller, wherein the card processing device is in line with the processing path;

an auxiliary input displaced from the main card input and the processing path, and positioned in line with an auxiliary input path, which is transverse to the processing path, the auxiliary input configured to receive individual card substrates for travel along the auxiliary input path; and a card rotator configured to rotate individual card substrates to a plurality of indexed angular orientations including a first orientation in which the card rotator is oriented to the processing path and a second orientation in which the card rotator is oriented to the auxiliary input path.

2. The credential manufacturing device of claim 1, wherein the processing path and the auxiliary input path are each substantially flat.

3. The credential manufacturing device of claim 2, wherein the processing path and the auxiliary input path are approximately perpendicular to each other.

4. The credential manufacturing device of claim 1, wherein the card rotator comprises:

a substrate support configured to support a received card substrate in a substrate support plane and rotate about a central axis; and a substrate feeder configured to feed a card substrate along the substrate support plane relative to the substrate support.

5. The credential manufacturing device of claim 4, wherein the card rotator comprises a card sensor comprising an output signal indicative of whether a card substrate is positioned at a predetermined location relative to the substrate support.

6. The credential manufacturing device of claim 1, wherein:

the indexed angular positions of the card rotator include a first encoding orientation aligned with a first encoding path, which is transverse to the processing path and the auxiliary input path; and the credential manufacturing device further comprising a first data encoder configured to encode data to a card substrate in the first encoding path.

7. The credential manufacturing device of claim 6, wherein:

the indexed angular positions of the card rotator include a second encoding orientation aligned with a second encoding path, which is transverse to the processing path, the auxiliary input path and the first encoding path; and the credential manufacturing device further comprising a second data encoder configured to encode data to a card substrate in the second encoding path.

8. The credential manufacturing device of claim 1, further comprising a card output at an end of the processing path that is opposite the card supply through which processed card substrates are discharged.

9. The credential manufacturing device of claim 1, further comprising:

a first card sensor adjacent the main card input and configured to detect the feeding of a card substrate through the main card input to the processing path; and a second card sensor adjacent the auxiliary input and configured to detect the feeding of a card substrate through the auxiliary input to the auxiliary input path.

10. A method of processing a plastic card substrate in a credential manufacturing device, which comprises a supply of plastic card substrates contained in a card supply positioned adjacent to a main card input, a card transport configured to feed individual card substrates from the card supply through the main card input and along a processing path, a card processing device selected from the group consisting of a print head and a laminating roller, the card processing device is configured to process card substrates traveling along the processing path, an auxiliary input displaced from the main card input and the processing path and in line with an auxiliary input path, which is transverse to the processing path, a card rotator configured to rotate individual card substrates to a plurality of indexed angular orientations including a first orientation in which the card rotator is oriented to the processing path and a second orientation in which the card rotator is oriented to the auxiliary input path, the method comprising:

inserting a plastic card substrate through the auxiliary input;

orienting the card rotator in the second orientation;

delivering the plastic card substrate along the auxiliary input path to the card rotator;

receiving the plastic card substrate in the card rotator;

rotating the plastic card substrate in the card rotator to the first orientation; and processing the plastic card substrate using the card processing device.

11. The method of claim 10, wherein:

the card processing device comprises a print head; and processing the plastic card substrate using the card processing device comprises printing an image to a surface of the plastic card substrate.

12. The method of claim 10, including feeding individual plastic card substrates from the card supply along the processing path.

13. The method of claim 12, wherein the auxiliary input path is approximately perpendicular to the processing path.

14. The method of claim 13, further comprising discharging the plastic card substrate through a card output that is aligned with the processing path.

15. The method of claim 10, wherein:

the card processing device comprises a data writer; and processing the plastic card substrate using the card processing device comprises writing data to the plastic card substrate.

16. The method of claim 10, wherein:

the card processing device comprises a laminating roller; and processing the plastic card substrate using the card processing device comprises laminating an overlaminate material to a surface of the plastic card substrate.

17. A method of processing a plastic card substrate in a credential manufacturing device, which comprises a supply of plastic card substrates contained in a card supply positioned adjacent to a main card input, a card transport configured to feed individual card substrates from the card supply through the main card input and along a processing path, a print head in line with the processing path, an auxiliary input displaced from the main card input and the processing path and in line with an auxiliary input path, which is transverse to the processing path, a card rotator configured to rotate individual card substrates to a plurality of indexed angular orientations including a first orientation in which the card rotator is oriented to the processing path and a second orientation in which the card rotator is oriented to the auxiliary input path, the method comprising:

inserting a first plastic card substrate through the auxiliary input;

orienting the card rotator in the second orientation;

delivering the first plastic card substrate along the auxiliary input path to the card rotator;

receiving the first plastic card substrate in the card rotator;

rotating the first plastic card substrate using the card rotator to the first orientation; and transporting the first card substrate along the processing path to the print head; and printing an image on the surface of the first plastic card substrate using the print head.

18. The method of claim 17, further comprising:

transporting the first plastic card substrate along the processing path to a card output positioned at an end of the device that is opposite the card supply; and discharging the first plastic card substrate through the card output.

19. The method of claim 17, further comprising:

transporting a second plastic card substrate from the card supply along the processing path;

printing an image on the surface of the second plastic card substrate using the print head; and discharging the second card substrate through a card output positioned at an end of the device that is opposite the card supply.

* * * * *